US008529129B2

(12) United States Patent
Turvey

(10) Patent No.: US 8,529,129 B2
(45) Date of Patent: Sep. 10, 2013

(54) CLOSURE ELEMENT FOR A POUCH

(75) Inventor: Robert R. Turvey, Sanford, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 1396 days.

(21) Appl. No.: 12/047,454

(22) Filed: Mar. 13, 2008

(65) Prior Publication Data

US 2009/0232421 A1 Sep. 17, 2009

(51) Int. Cl.

| | |
|---|---|
| ***B65D 30/24*** | (2006.01) |
| ***B65D 33/16*** | (2006.01) |
| ***B65D 33/00*** | (2006.01) |

(52) U.S. Cl.

USPC ..... 383/63; 383/44; 383/94

(58) Field of Classification Search

USPC ..... 383/44, 94, 92, 100, 103, 59; 24/585.12
See application file for complete search history.

(56) References Cited

U.S. PATENT DOCUMENTS

| | | | | |
|---|---|---|---|---|
| 3,279,330 | A | 10/1966 | Harding | |
| 3,302,859 | A | 2/1967 | Perry | |
| 3,381,887 | A | 5/1968 | Lowry | |
| 3,991,801 | A | 11/1976 | Ausnit | |
| 4,484,352 | A | 11/1984 | Katzin | |
| 4,532,652 | A | 7/1985 | Herrington | |
| 4,741,789 | A | 5/1988 | Zieke et al. | |
| 4,755,248 | A | 7/1988 | Geiger et al. | |
| 4,927,474 | A | 5/1990 | Pawloski | |
| 5,012,561 | A | 5/1991 | Porchia et al. | |
| 5,070,584 | A | 12/1991 | Dais et al. | |
| 5,478,228 | A | 12/1995 | Dais et al. | |
| 5,655,273 | A | 8/1997 | Tomic et al. | |
| 5,689,866 | A | 11/1997 | Kasai et al. | |
| 5,829,884 | A | 11/1998 | Yeager | |
| 5,839,582 | A | 11/1998 | Strong et al. | |
| 5,911,508 | A | 6/1999 | Dobreski et al. | |
| 5,996,800 | A | 12/1999 | Pratt | |
| 6,010,244 | A | 1/2000 | Dobreski et al. | |
| 6,021,557 | A | 2/2000 | Dais et al. | |
| 6,070,728 | A * | 6/2000 | Overby et al. | 206/524.8 |
| 6,185,796 | B1 | 2/2001 | Ausnit | |
| 6,210,724 | B1 | 4/2001 | Clarke et al. | |
| 6,231,236 | B1 | 5/2001 | Tilman | |
| 6,299,353 | B1 * | 10/2001 | Piechocki et al. | 383/63 |
| 6,692,147 | B2 | 2/2004 | Nelson | |
| 6,954,969 | B1 | 10/2005 | Sprehe | |
| 7,041,249 | B2 | 5/2006 | Wright et al. | |
| 7,137,736 | B2 | 11/2006 | Pawloski et al. | |
| 7,784,160 | B2 | 8/2010 | Dais et al. | |
| 7,857,515 | B2 | 12/2010 | Dais et al. | |
| 7,874,731 | B2 | 1/2011 | Turvey et al. | |

(Continued)

*Primary Examiner* — Gary Elkins
*Assistant Examiner* — Christopher Demeree

(57) ABSTRACT

A closure mechanism for a pouch includes a first interlocking closure element and a second interlocking closure element. A first closure profile is disposed on an interior side of the first interlocking closure element. A flange extends from the first closure profile and has a first aperture disposed therethrough. A resilient valve flap covers the first aperture and is attached to an exterior side of the flange. The resilient valve flap includes a sealing member and an at least partially elastomeric latch attached between a distal end of the sealing member and the exterior side of the flange. A channel is defined between the resilient valve flap and the flange that extends from the first aperture to an edge of the resilient flap. The resilient valve flap is biased to form a releasable airtight seal against the exterior side of the flange across the channel.

16 Claims, 12 Drawing Sheets

(56) References Cited

U.S. PATENT DOCUMENTS

| | | | | |
|---|---|---|---|---|
| 7,886,412 | B2 | 2/2011 | Dais et al. | |
| 7,887,238 | B2 | 2/2011 | Turvey et al. | |
| 7,946,766 | B2 | 5/2011 | Dais et al. | |
| 7,967,509 | B2 | 6/2011 | Turvey et al. | |
| 2003/0066267 | A1* | 4/2003 | Nelson | 53/412 |
| 2004/0057636 | A1 | 3/2004 | Ishizaki | |
| 2004/0091179 | A1 | 5/2004 | Anderson | |
| 2004/0136618 | A1 | 7/2004 | Ausnit et al. | |
| 2004/0146226 | A1* | 7/2004 | Wolak et al. | 383/210 |
| 2004/0234172 | A1 | 11/2004 | Pawloski | |
| 2004/0252915 | A1 | 12/2004 | Nelson | |
| 2005/0286808 | A1 | 12/2005 | Zimmerman et al. | |
| 2006/0048483 | A1 | 3/2006 | Tilman et al. | |
| 2006/0093242 | A1 | 5/2006 | Anzini et al. | |
| 2006/0111226 | A1 | 5/2006 | Anzini et al. | |
| 2006/0228057 | A1 | 10/2006 | Newrones et al. | |
| 2007/0154118 | A1 | 7/2007 | Tilman et al. | |
| 2007/0155607 | A1 | 7/2007 | Bassett et al. | |
| 2007/0172157 | A1 | 7/2007 | Buchman | |
| 2008/0308177 | A1 | 12/2008 | Thuot et al. | |
| 2008/0310771 | A1* | 12/2008 | Dais et al. | 383/59 |
| 2009/0175747 | A1 | 7/2009 | LeBoeuf et al. | |

* cited by examiner

CLOSURE ELEMENT FOR A POUCH

CROSS REFERENCE TO RELATED APPLICATIONS

Not Applicable

REFERENCE REGARDING FEDERALLY SPONSORED RESEARCH OR DEVELOPMENT

Not Applicable

SEQUENTIAL LISTING

Not Applicable

BACKGROUND OF THE INVENTION

1. Field of the Invention

The present disclosure relates generally to closure mechanisms, and particularly, to a closure mechanism that includes a valve structure that may be used on a container, such as a pouch.

2. Description of the Background of the Invention

Food is or other perishables are often stored in containers such as thermoplastic pouches. A thermoplastic pouch having a resealable closure mechanism extending along an opening into an interior thereof may be repeatedly opened and closed. In order to keep the food stored inside the pouch fresh for an extended period, a user may expel excess air out of the pouch before completely sealing the closure mechanism. Some pouches allow a vacuum to be formed inside the pouch and then be sealed so as to vacuum pack the contents of the pouch. Other pouches have been developed that have a separate air evacuation route so that air may be removed from the pouch after the closure mechanism has already been sealed.

One closure mechanism on a pouch has a directional exhaust aperture through the closure mechanism. The closure mechanism has a first closure element attached to one pouch wall and a second closure element attached to a second pouch wall opposite to the first pouch wall. The first closure element has a first base portion and a female closure profile extending from the first base. The second closure element has a second base portion and a male closure profile extending from the second base. The female profile interlocks with the male profile in a closed position. A cantilevered valve flange extends from the first base toward the second base. The flange is spaced from the male and female closure profiles on a product side of the closure mechanism. An aperture through the first base is disposed between the female profile and the cantilevered valve flange. The cantilevered valve flange is biased in sealing engagement against the second base in the closed position to prevent air from entering the pouch through the aperture. In response to higher relative pressure from within the pouch, the valve flange separates from the second base and allows air to escape through the aperture.

Other closure mechanisms on pouches have a reclosable seal having opposing closure elements and a bidirectional vent. In one embodiment, the vent has an aperture through a fin extending downwardly from one of the closure elements. A portion of a pouch wall extends loosely above the aperture to prevent insects from entering the pouch through the aperture. A tamper evident partition extends between the two closure elements. In another embodiment, the pouch wall extends above the aperture on an inner side of the fin, and a tamper evident partition extends between the pouch wall and an opposing bag wall. In yet another embodiment, the aperture is through the pouch wall, and the fin extends below the aperture.

Another closure mechanism on a pouch has opposing front and back pouch walls, the closure mechanism sealingly mounted to the front wall, and a one-way vent through the front pouch wall adjacent to the closure mechanism. The closure mechanism is disposed on an interior portion of the front pouch wall, and a frangible portion of the front pouch wall provides access to the closure mechanism for operating the mechanism. A gap in the seal mount of the closure mechanism, an aperture through the front pouch wall within the seal mount, and a flap between the gap and the aperture form a vent from an interior of the pouch through the front pouch wall. The flap allows air to exit the interior of the pouch and prevents air from entering the interior of the pouch through the vent.

Still another closure mechanism on a pouch has an exhaust vent in a side wall of the pouch. The vent has a backing member extending from a closure element along an interior side of a pouch wall and an aperture through the pouch wall. The aperture is disposed opposite to the backing member such that the backing member covers the aperture. The pouch wall is sealed to the backing member around a portion of the aperture defining a passageway through which air may pass at an unsealed portion. The unsealed portion of the pouch wall allows air to escape out of the pouch through the aperture and prevents air from entering the pouch through the aperture.

Yet another closure mechanism on a pouch has a first closure element having a female profile extending from a base with a first pouch sidewall extending therefrom. Apertures through the base of the female profile provide communication between a space between first and second female legs that extend from the base and an opposite side of the base so that a male profile inserted into the female profile will urge any particles lodged in the space to pass through the apertures, out of the closure mechanism, and back into an interior of the pouch.

SUMMARY OF THE DISCLOSURE

According to one aspect of the disclosure, a closure mechanism for a pouch comprises a first interlocking closure element and a second interlocking closure element. A first closure profile is disposed on an interior side of the first interlocking closure element. A flange extends from the first closure profile and a first aperture is disposed therethrough. A resilient valve flap covers the first aperture and is attached to an exterior side of the flange. A channel is defined between the resilient valve flap and the flange that extends from the first aperture to an edge of the resilient valve flap. The resilient valve flap is biased to form a releasable airtight seal against the exterior side of the flange across the channel.

According to another aspect of the disclosure, a closure element for a pouch comprises a closure profile and a flange that extends from the closure profile and has a first aperture disposed therethrough. The flange has first and second opposite sides and the closure profile is arranged on a first side of the flange. A resilient valve flap covers the first aperture and is attached to the flange. A channel is defined between the resilient valve flap and the flange that extends from the aperture to an edge of the resilient valve flap. The resilient valve flap is biased to form an airtight seal against the second side of the flange across the channel.

According to yet another aspect of the disclosure, a resealable valve comprises a flange extending from a closure element and including an aperture disposed therethrough and in fluid communication with an interior side of the closure element. The aperture extends through the flange from the interior side of the flange. A resilient valve flap covers the aperture on the exterior side of the flange and is attached to the exterior side of the flange. A channel is defined between the resilient valve flap and the flange that extends from the aperture to an edge of the resilient valve flap. The resilient valve flap is biased to form a releasable airtight seal against the exterior side of the flange across the channel.

BRIEF DESCRIPTION OF THE DRAWINGS

Other aspects and advantages of the present disclosure will become apparent upon consideration of the following detailed description, wherein similar structures have similar reference numerals.

DETAILED DESCRIPTION

Figure 1:
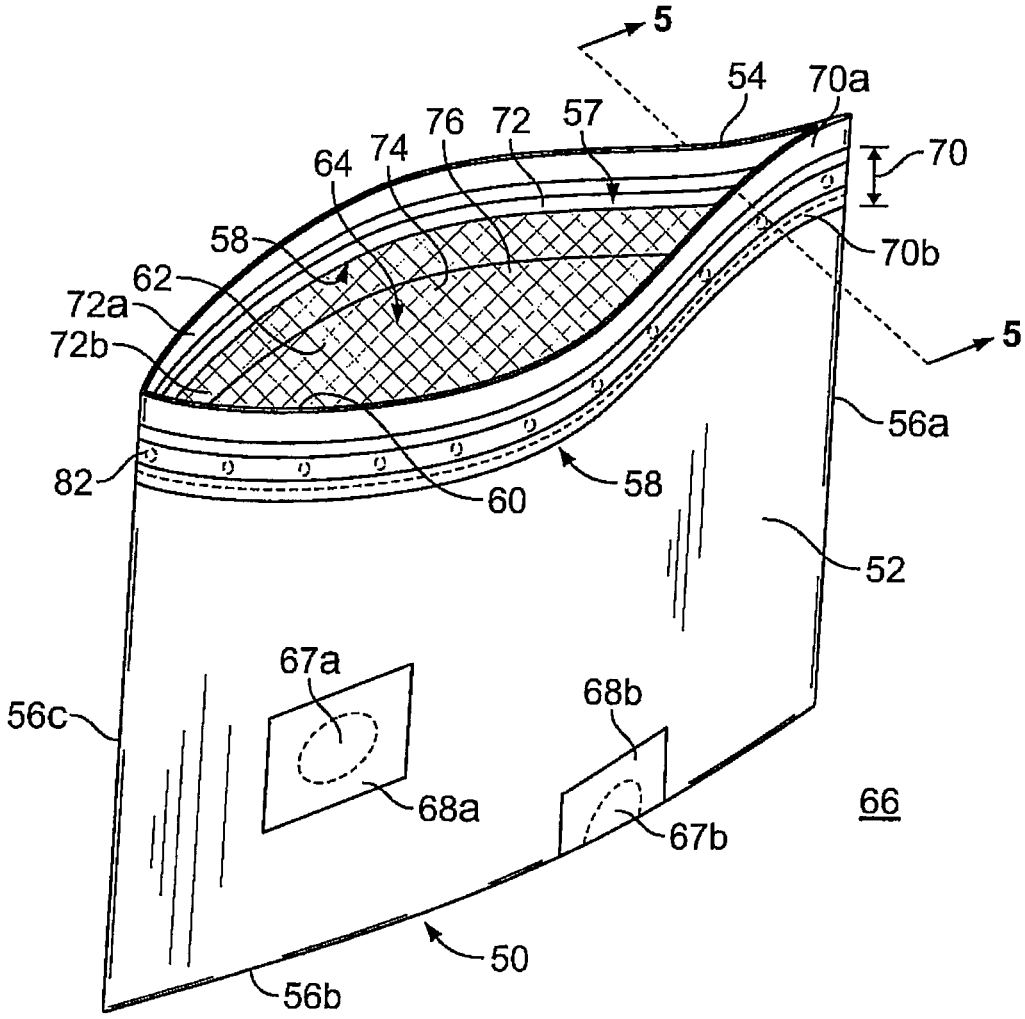
FIG. 1 is an isometric view of a reclosable pouch.

Referring to FIG. 1, a reclosable thermoplastic pouch 50 includes first and second pouch sidewalls 52 and 54 joined around three edges 56*a*-56*c* by heat sealing, or another sealing method known in the art, to define a primary opening 57. Alternatively, the bottom edge 56*b* may be a fold line between the first and second side walls 52 and 54. A closure mechanism 58 is attached to inner surfaces 60 and 62 of the first and second sidewalls 52 and 54, respectively, proximate to the primary opening 57. The closure mechanism 58 and the first and second sidewalls 52 and 54 define a pouch interior 64. The closure mechanism 58 allows the pouch 50 to be repeatedly opened and closed. When occluded, the closure mechanism 58 provides an airtight seal such that a vacuum may be maintained in the pouch interior 64 for a desired period of time, such as days, months, or years, when the closure mechanism is sealed fully across the primary opening 57. The closure mechanism 58 comprises first and second complementary interlocking closure elements 70, 72 that are attached, respectively, to the inner surfaces 60 and 62 of the first and second sidewalls 52 and 54.

A secondary opening 67*a*, 67*b*, allows fluid communication between the interior 64 and an exterior 66 of the pouch 50. The secondary opening 67*a* may extend through either the first or second sidewall 52, 54. The secondary opening 67*b* may extend through a side edge 56*a*-56*c*, for example, through the bottom edge 56*b*. One or more valves 68*a*, 68*b* may optionally be disposed in or covering each respective secondary opening 67*a*, 67*b* to allow air to be evacuated from the pouch interior 64 and/or to maintain a vacuum when the closure mechanism 58 has been sealed. As shown in FIG. 1, the valves 68*a*, 68*b* may, for example, be disposed on the first sidewall 52 spaced from the closure mechanism 58. The valve 68*a*, 68*b* provides a fluid path with fluid communication between the pouch interior 64 and the exterior 66 of the pouch. Illustrative valves useful in the present disclosure include those disclosed in, for example, Newrones et al. U.S. Patent Application Publication No. 2006/0228057, Buchman U.S. Patent Application Publication No. 2007/0172157, and Tilman et al. U.S. Patent Application Publication No. 2007/0154118. Other valves useful in the present disclosure include those disclosed in, for example, U.S. patent application Ser. No. 11/818,586, now U.S. Pat. No. 7,946,766, No. 11/818,591, now U.S. Pat. No. 7,874,731, and No. 11/818,592, now U.S. Pat. No. 7,967,509, each filed on Jun. 15, 2007.

Figure 2:
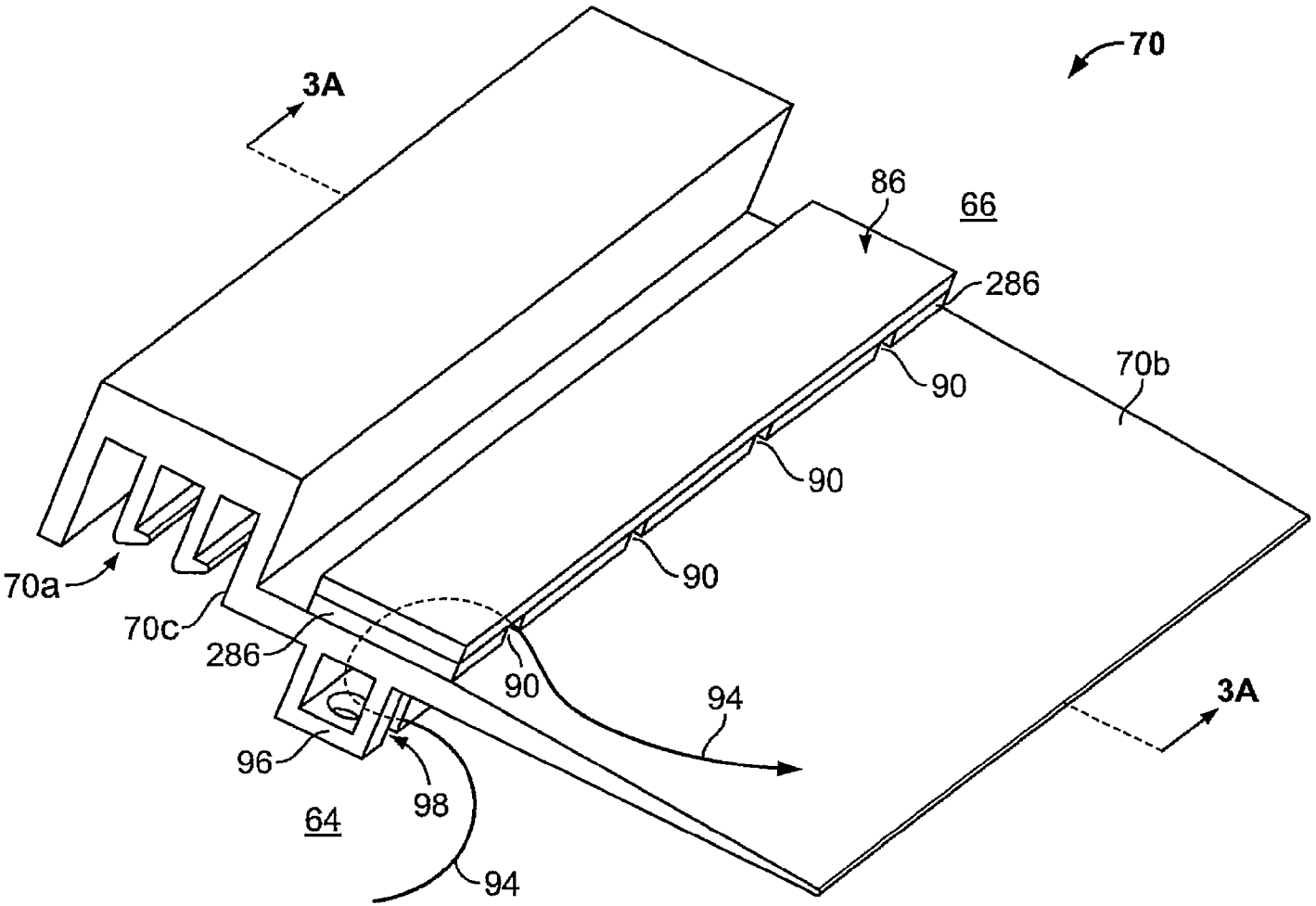
FIG. 2 is an isometric view of an embodiment of a first closure element.
Figure 3:
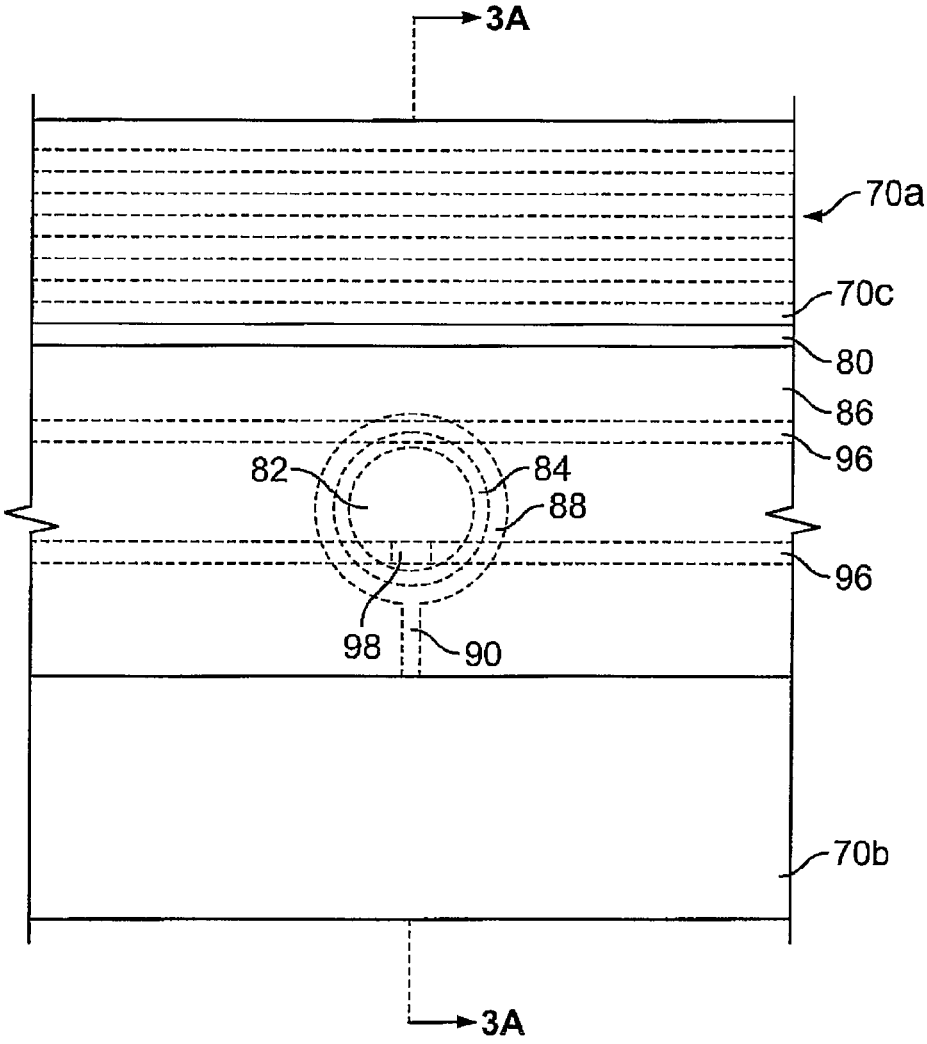
FIG. 3 is a plan view of the embodiment of FIG. 2.
Figure 4:
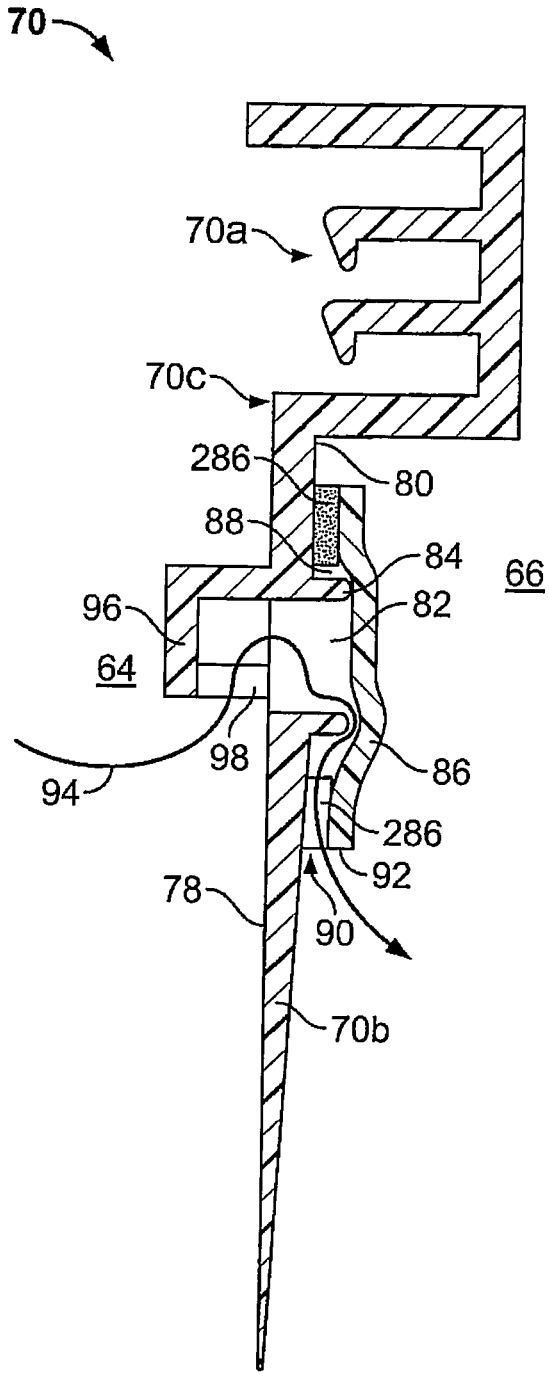
FIG. 4 is a cross-sectional view of the embodiment of FIG. 2 in an unsealed state taken generally along the lines 3A-3A of FIG. 2 and FIG. 3.

The first complementary interlocking closure element 70 includes a first closure profile 70*a* and a first flange 70*b* extending from the first closure profile. The second complementary interlocking closure element 72 includes a second closure profile 72*a* and may include a second flange 72*b* extending from the second closure profile. In one embodiment, the first closure profile 70*a* has a first flange 70*b* extending from an edge 70*c* thereof, as shown in FIGS. 2-4. The first flange 70*b* includes an interior side 78 and an exterior side 80. A first aperture 82, as seen in FIGS. 3-4, is disposed through the first flange 70*b* to provide fluid communication between the interior side 78 and the exterior side 80 of the first flange. Although the first aperture 82 is illustrated, for example, in FIG. 3 to be circular, the first aperture may have any convenient shape such as elliptical, triangular, square-shaped, pentagonal, hexagonal, or other shapes. A plurality of first apertures 82 may be distributed along a partial length of the closure mechanism 58, or along the entire length of the closure mechanism, as shown in FIG. 1.

Figure 3A:
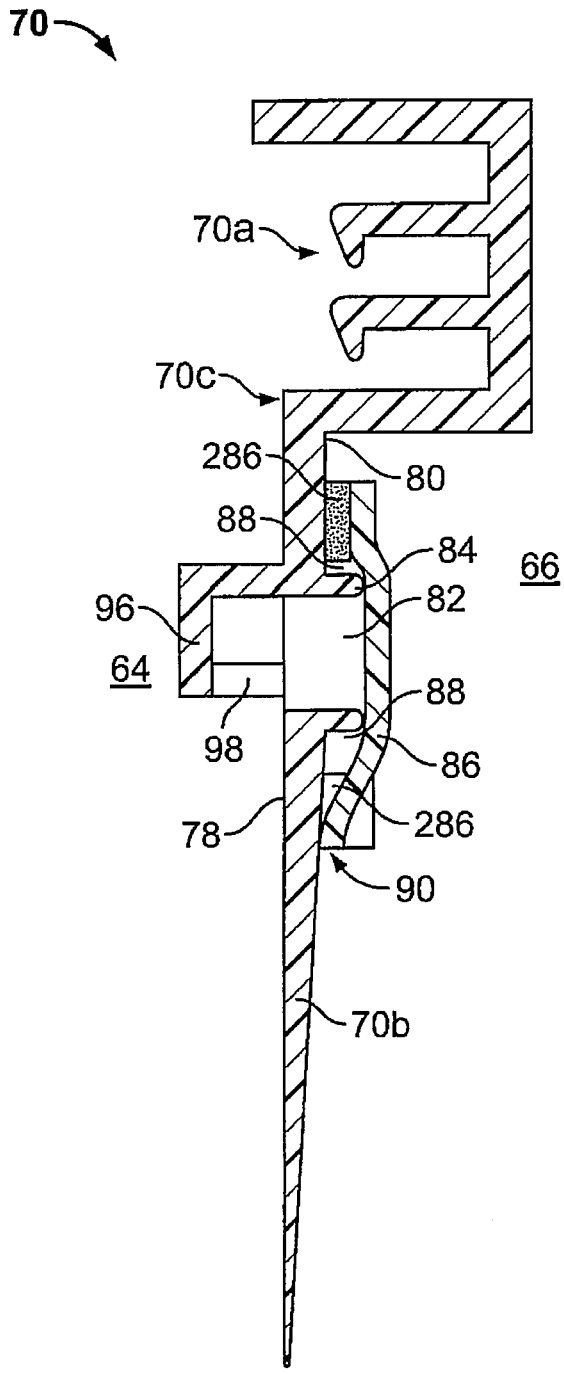
FIG. 3A is a cross-sectional view of the embodiment of FIG. 2 in a sealed state taken generally along the lines 3A-3A of FIG. 2 and FIG. 3.

FIGS. 3A and 4 depict the resilient valve flap 86 in a sealed state and an open state, respectively. As best seen in FIG. 3A, a raised lip 84 may extend from the exterior side 80 of the flange 70*b* around a periphery of the first aperture 82. A resilient valve flap 86 that covers the first aperture 82 is sealed to the exterior side 80 of the first flange 70*b*. The resilient valve flap 86 may be sealed against the exterior side 80 of the first flange 70*b* by a sealing layer 286, as shown in FIGS. 2-6. The sealing layer 286 may utilize any sealing method known in the art, for example, a heat seal, an adhesive, or a thermoplastic weld layer. The raised lip 82 displaces the resilient valve flap 86 away from the exterior side 80 of the first flange 70*b*. This displacement 88, best seen in FIG. 3A, biases the resilient valve flap 86 to form a releasable seal against the raised lip 84. As best seen in FIG. 4, a channel 90 is defined between the resilient valve flap 86 and the exterior side 80 of the first flange 70*b* where the resilient valve flap and the exterior side are not sealed to one another. The channel 90 extends from the first aperture 82 to an edge 92 of the resilient valve flap 86.

In this embodiment, the resilient valve flap 86 may function as a one-way check valve. For example, the pouch 50 may have the closure mechanism 58 occluded with a positive pressure difference across the resilient valve flap 86 from the exterior 66 to the interior 64 of the pouch, wherein the positive pressure difference allows the resilient valve flap to remain in a biased sealed position, as shown in FIG. 3A. However, a positive pressure difference across the resilient valve flap 86 from the interior 64 to the exterior 66 may cause the resilient valve flap to separate from the raised lip 84 if the positive pressure difference is greater than a threshold level required to overcome the sealing bias of the resilient valve flap, as shown in FIG. 4.

FIG. 4 illustrates the resilient valve flap 86 that has separated from the raised lip 84 under a sufficient positive pressure difference. The channel 90 provides a fluid path, as indicated by the curved arrow 94, for fluid such as air to escape from the interior 64 to the exterior 66 of the pouch 50. Upon a decrease of the positive pressure difference to below the threshold level required to overcome the sealing bias of the resilient valve flap 86, the resilient valve flap returns to a sealing position as shown in FIG. 3A.

Figure 5:
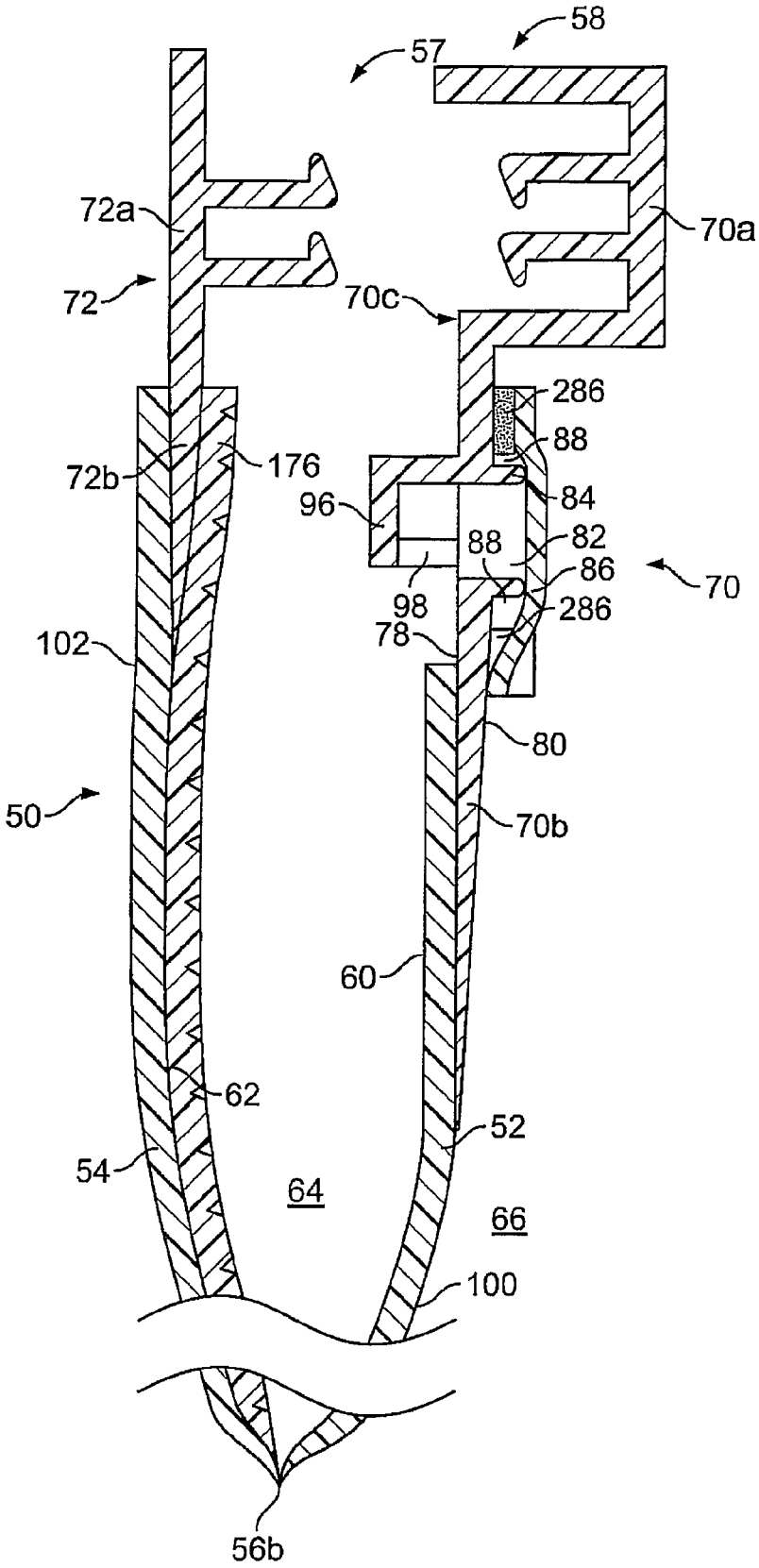
FIG. 5 is a fragmentary cross-sectional view of the embodiment of FIG. 2 attached to a pouch that has an attached textured wall taken generally along the lines 5-5 of FIG. 1 with portions behind the plane of the cross section omitted for clarity.

The first complementary interlocking closure element 70 may also include a third profile 96 that extends from the interior side 78 of the first flange 70*b*. As shown in FIGS. 2-6, the third profile 96 may be hollow or have a second aperture 98 therethrough. The third profile 96 may make contact with the inner surface 62 of the second sidewall 54 when the closure mechanism 58 is occluded, and inhibits and/or prevents the inner surface from blocking the first aperture 82, thereby providing a fluid path from the interior 64 of the pouch 50 through the aperture 82, as depicted by the curved arrow 94. As shown in FIG. 1, the pouch 50 may also include a relief such as embossing or texturing on or along an interior surface of one or both of the first and second sidewalls 52, 54 to provide fluid or air flow channels 74 between the sidewalls when fluid is being evacuated from the pouch 50, or when a vacuum, for example, is being drawn through the valve 68*a*, 68*b* or through the first complementary interlocking closure element 70. In this manner, the pouch 50 provides an evacuable system within which items, for example, food, may be stored. One or both sidewalls, such as the second sidewall 54, may also be embossed or otherwise textured 76 with a pattern, such as, for example, the diamond pattern shown in FIG. 1, to provide the air flow channels 74 on one or both surfaces spaced between the bottom edge 56*b* and the second closure profile 72*a*. Alternatively, a separate textured and embossed patterned wall 176, as shown in FIG. 5, may be used to provide additional flow channels (not shown) within the pouch interior 64, wherein the pattern extends from just beneath the second closure profile 72*a* to the bottom edge 56*b* and opposes the third closure profile to provide fluid communication between the interior 64 of the pouch 50 and the second aperture 98. Illustrative flow channels useful in the present disclosure include those disclosed in Zimmerman et al. U.S. Patent Application Publication No. 2005/0286808, Buchman U.S. Patent Application Publication No. 2007/0172157, and Tilman et al. U.S. Patent Application Publication Nos. 2006/0048483 and 2007/0154118. Other flow channels useful in the present disclosure include those disclosed in, for example, U.S. patent application Ser. No. 11/818,584, filed on Jun. 15, 2007, now U.S. Pat. No. 7,887,238.

Figure 6:
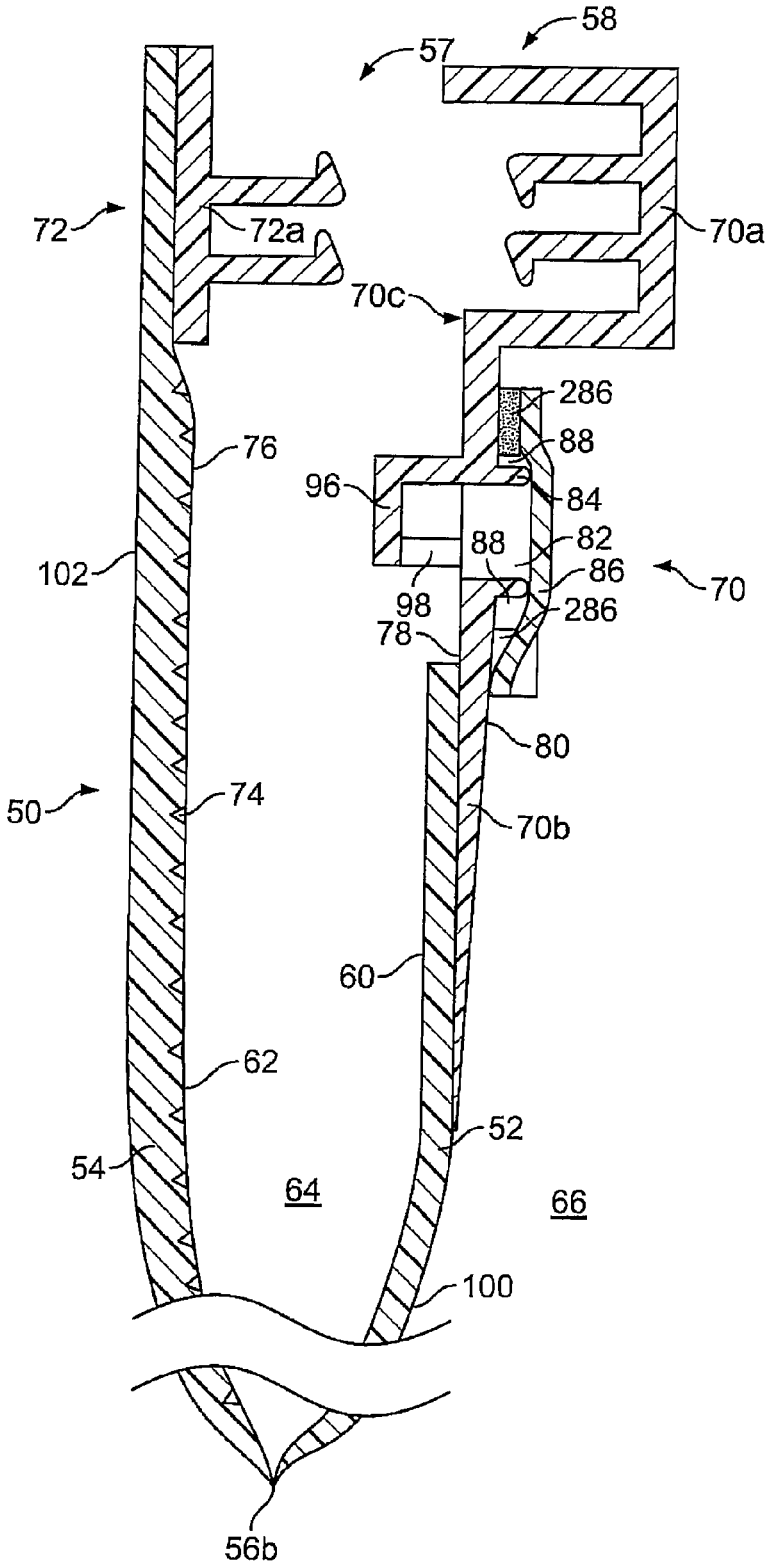
FIG. 6 is a fragmentary cross-sectional view of the embodiment of FIG. 2 attached to a pouch that has a textured second sidewall taken generally along the lines 5-5 of FIG. 1 with portions behind the plane of the cross section omitted for clarity.

The first complementary interlocking closure element 70 may be attached to the inner surface 60 of the first sidewall 52, or may illustratively be attached to an outer surface 100 of the first pouch wall 52, as shown in FIG. 5. Similarly, the second complementary interlocking closure element 72 may be attached to an outer surface 102 of the second pouch wall 54, or may illustratively be attached to the inner surface 62 of the second pouch wall, as shown in FIG. 5. It is contemplated further that the second complementary interlocking closure element 72 may comprise only the second closure profile 72*a* that is attached to the inner surface 62 of the second sidewall, as shown in FIG. 6. The textured 76 pattern can be seen in FIG. 6 on the inner surface of the second sidewall 54 and opposing the third profile 96.

The first and second closure profiles 70*a*, 72*a* may be generally hooked closure profiles, respectively, as shown in FIGS. 2-6. However, the configuration and geometry of the closure profiles 70*a*, 72*a* or closure elements 70, 72 disclosed herein may vary. Further, in some embodiments, a sealing material such as a polyolefin material or a caulking composition such as silicone grease may be disposed on or in the closure profiles 70*a*, 72*a* or closure elements 70, 72 to fill in any gaps or spaces therein when occluded. The ends of the interlocking profiles 70*a*, 72*a* or closure elements 70, 72 may also be welded or sealed by ultrasonic vibrations as is known in the art.

In a further embodiment (not shown), one or both of the first and second closure elements 70, 72 may include one or more textured portions, such as a bump or crosswise groove in one or more of the first and second closure profiles 70*a*, 72*a* in order to provide a tactile sensation, such as a series of clicks, as a user draws the fingers along the closure mechanism 58 to seal the closure elements across the primary opening 57. In addition, protuberances, for example, ridges (not shown), may be disposed on the inner surfaces 60, 62 of the respective first and second sidewalls 52, 54 proximate to the primary opening 57, to provide increased traction in a convenient area for a user to grip, such as a gripping flange, when trying to open the sealed pouch 50.

Illustrative interlocking profiles, closure elements, sealing materials, tactile or audible closure elements, and/or end seals useful in the present disclosure include those disclosed in, for example, Pawloski U.S. Pat. No. 4,927,474, Dais et al. U.S. Pat. Nos. 5,070,584, 5,478,228, and 6,021,557, Tomic et al., U.S. Pat. No. 5,655,273, Sprehe U.S. Pat. No. 6,954,969, Kasai et al. U.S. Pat. No. 5,689,866, Ausnit U.S. Pat. No. 6,185,796, Wright et al. U.S. Pat. No. 7,041,249, Pawloski et al. U.S. Pat. No. 7,137,736, Anderson U.S. Patent Application Publication No. 2004/0091179, Pawloski U.S. Patent Application Publication No. 2004/0234172, Tilman et al. U.S. Patent Application Publication No. 2006/0048483, and Anzini et al. U.S. Patent Application Publication Nos. 2006/0093242 and 2006/0111226. Other interlocking profiles and closure elements useful in the present disclosure include those disclosed in, for example, U.S. patent application Ser. No. 11/725,120, filed Mar. 16, 2007, now U.S. Pat. No. 7,886,412, and U.S. patent application Ser. No. 11/818,585, now U.S. Pat. No. 7,857,515, No. 11/818,586, now U.S. Pat. No. 7,946,766, and No. 11/818,593, now U.S. Pat. No. 7,784,160, each filed on Jun. 15, 2007. It is further appreciated that the interlocking profiles or closure elements disclosed herein may be operated by hand, or a slider (not shown) may be used to assist in occluding and de-occluding the interlocking profiles and closure elements. It is also contemplated that a pouch useful herein may also be closed by other methods known to those skilled in the art other than, or in conjunction with, interlocking profiles, including, for example, heat sealing as disclosed in, for example, Bassett et al. U.S. Patent Application Publication No. 2007/0155607.

Figure 7:
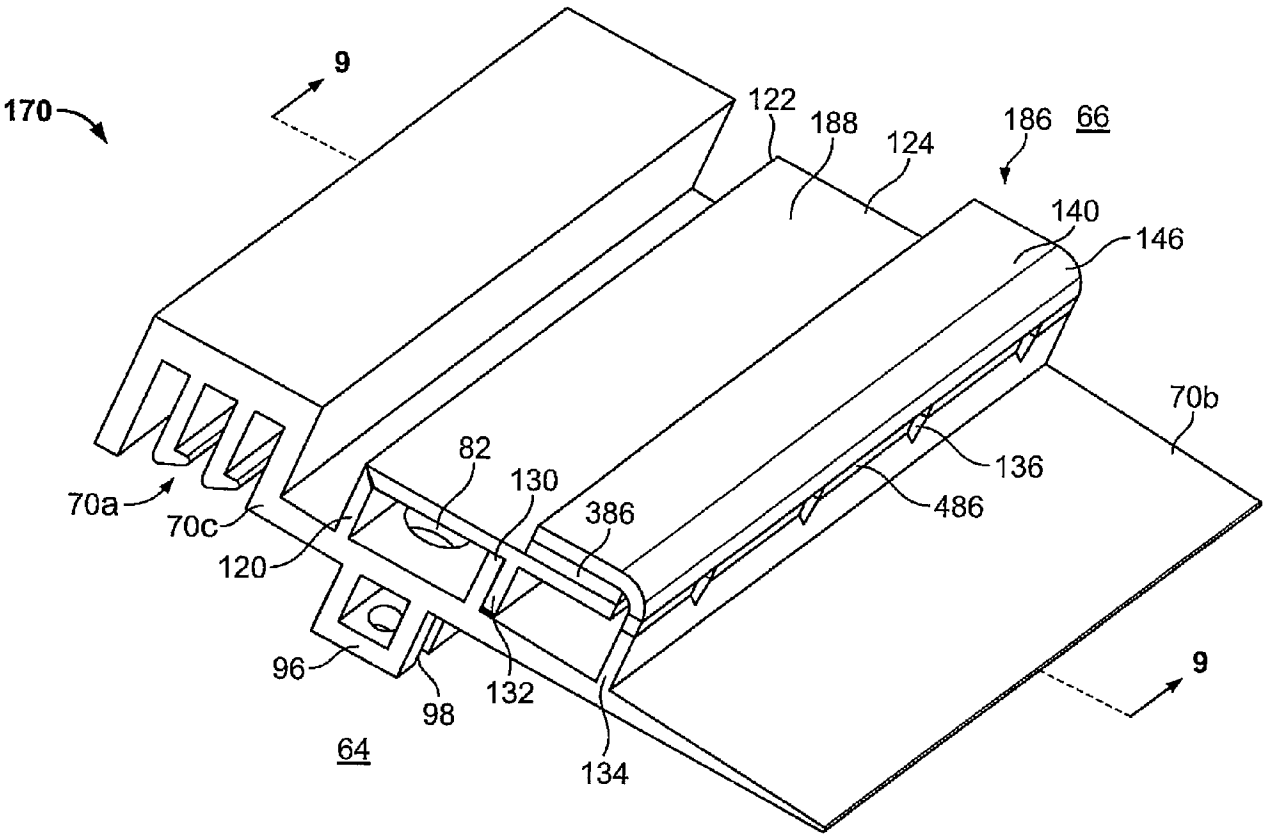
FIG. 7 is an isometric view of another embodiment of a first closure element in a sealed state.
Figure 8:
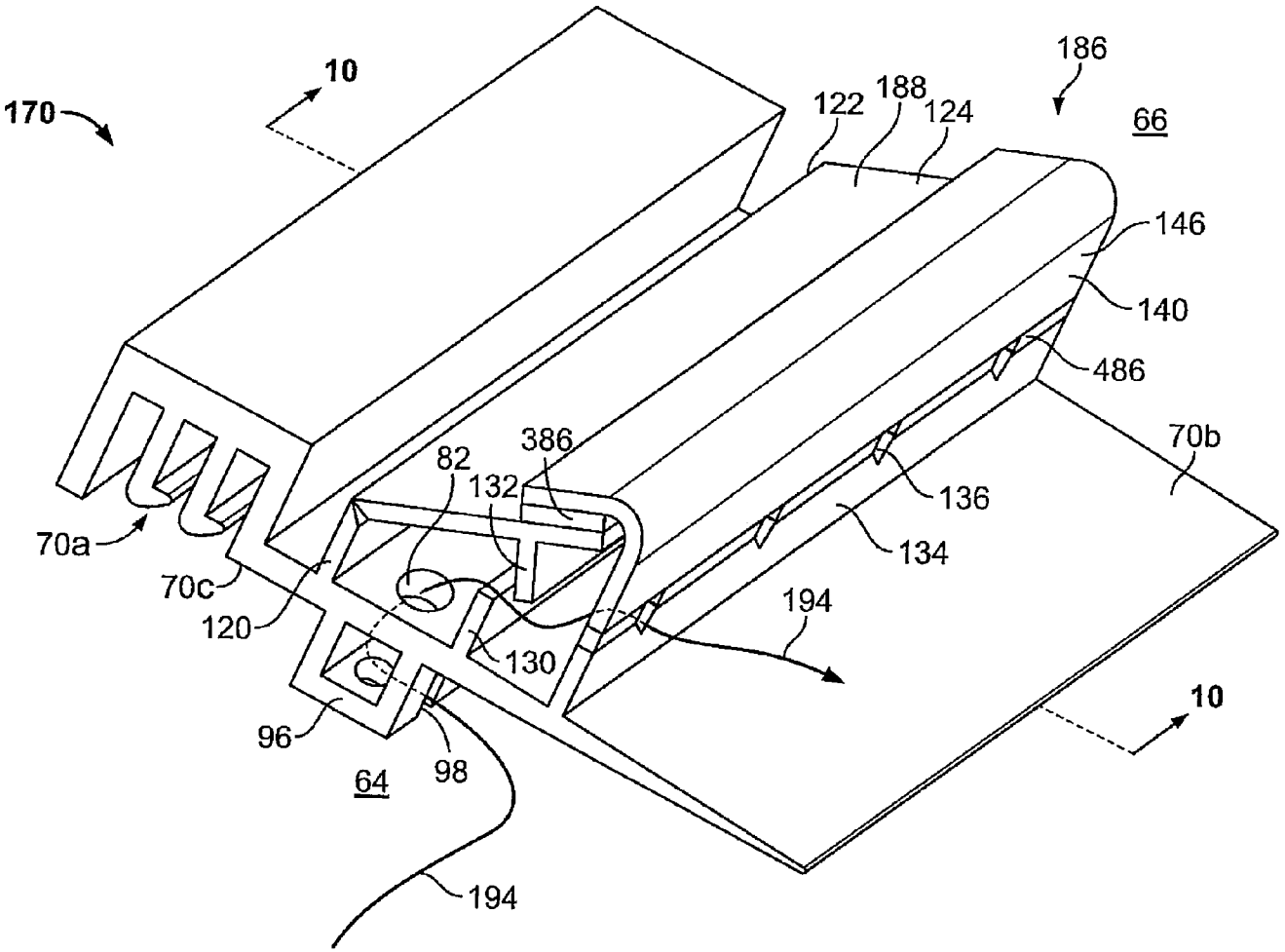
FIG. 8 is an isometric view of the embodiment of FIG. 7 in an unsealed state.
Figure 9:
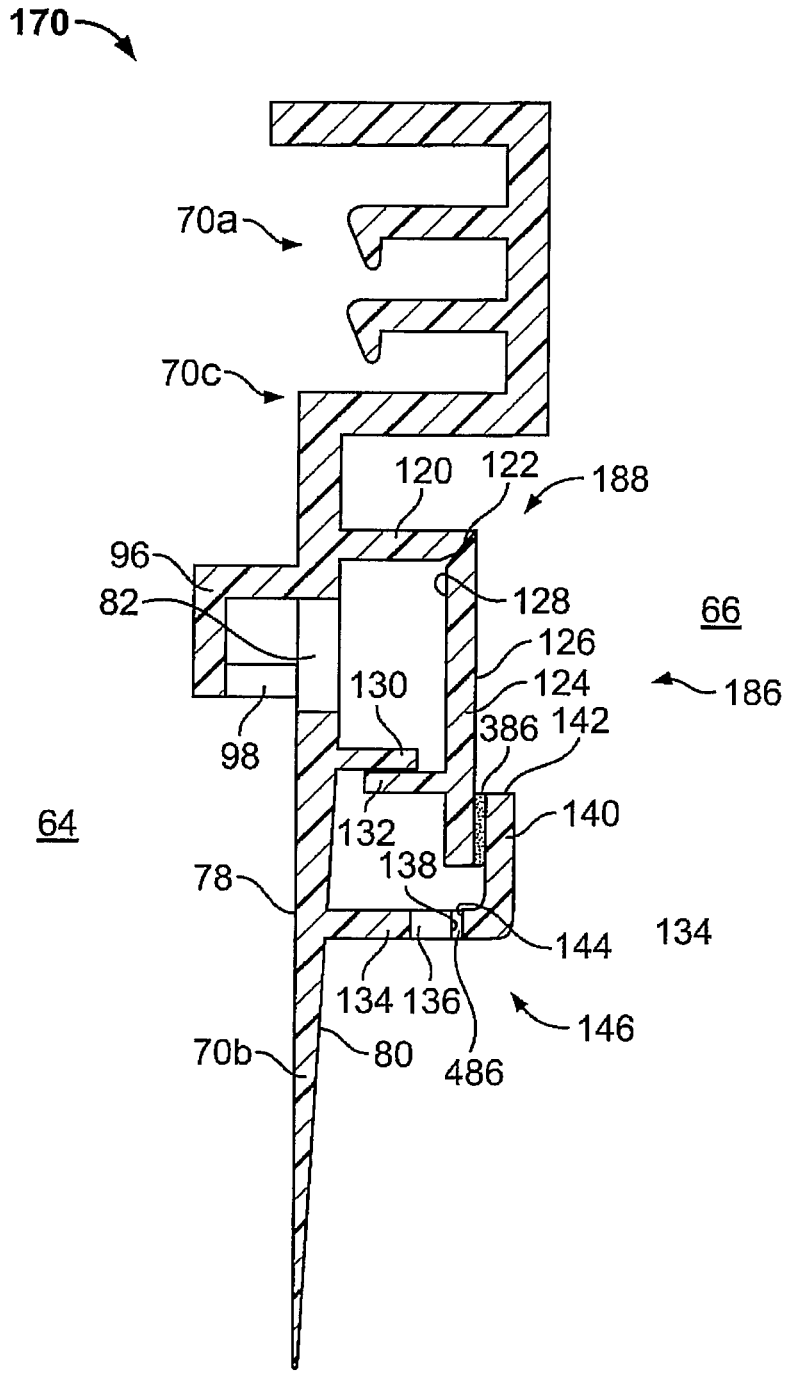
FIG. 9 is a cross-sectional view of the embodiment of FIG. 7 in a sealed state taken generally along the lines 9-9 of FIG. 7.
Figure 10:
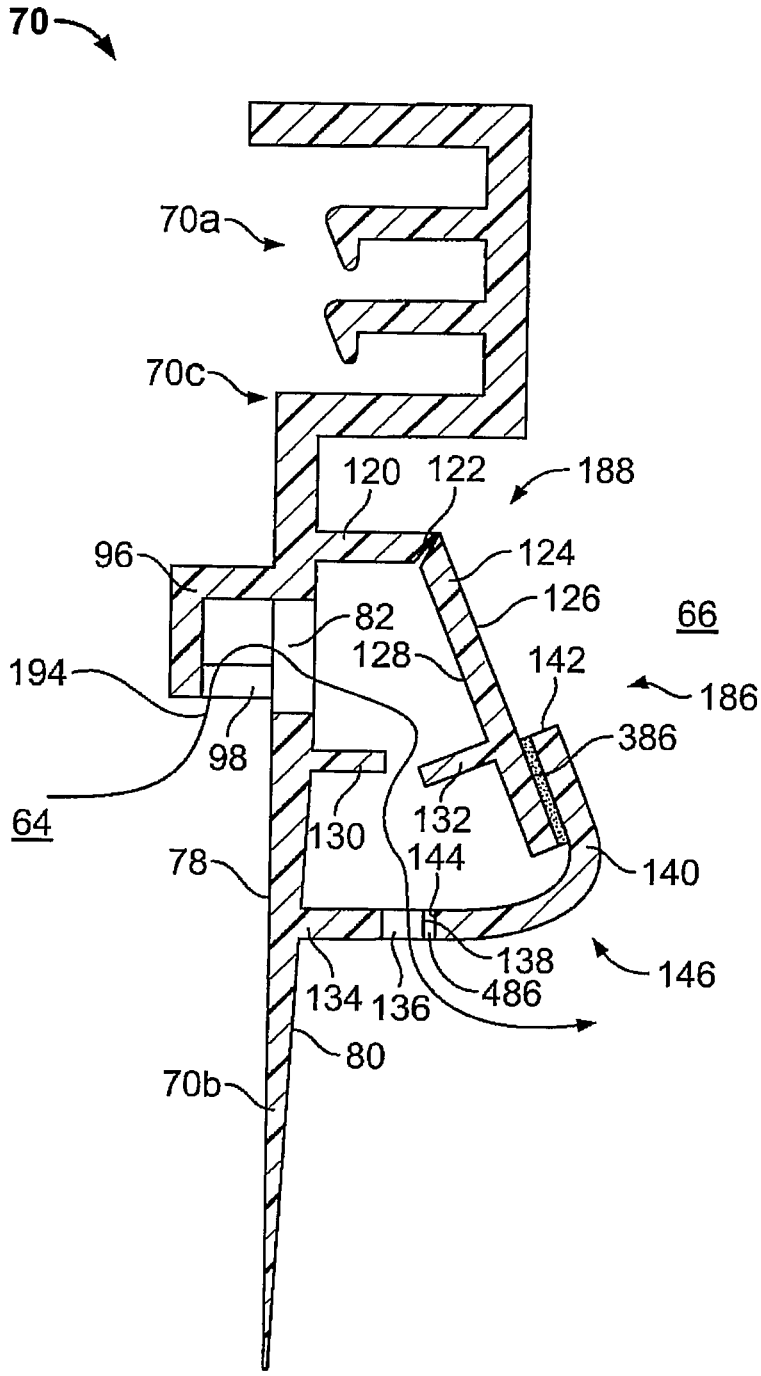
FIG. 10 is a cross-sectional view of the embodiment of FIG. 7 in an unsealed state taken generally along the lines 10-10 of FIG. 8.
Figure 10A:
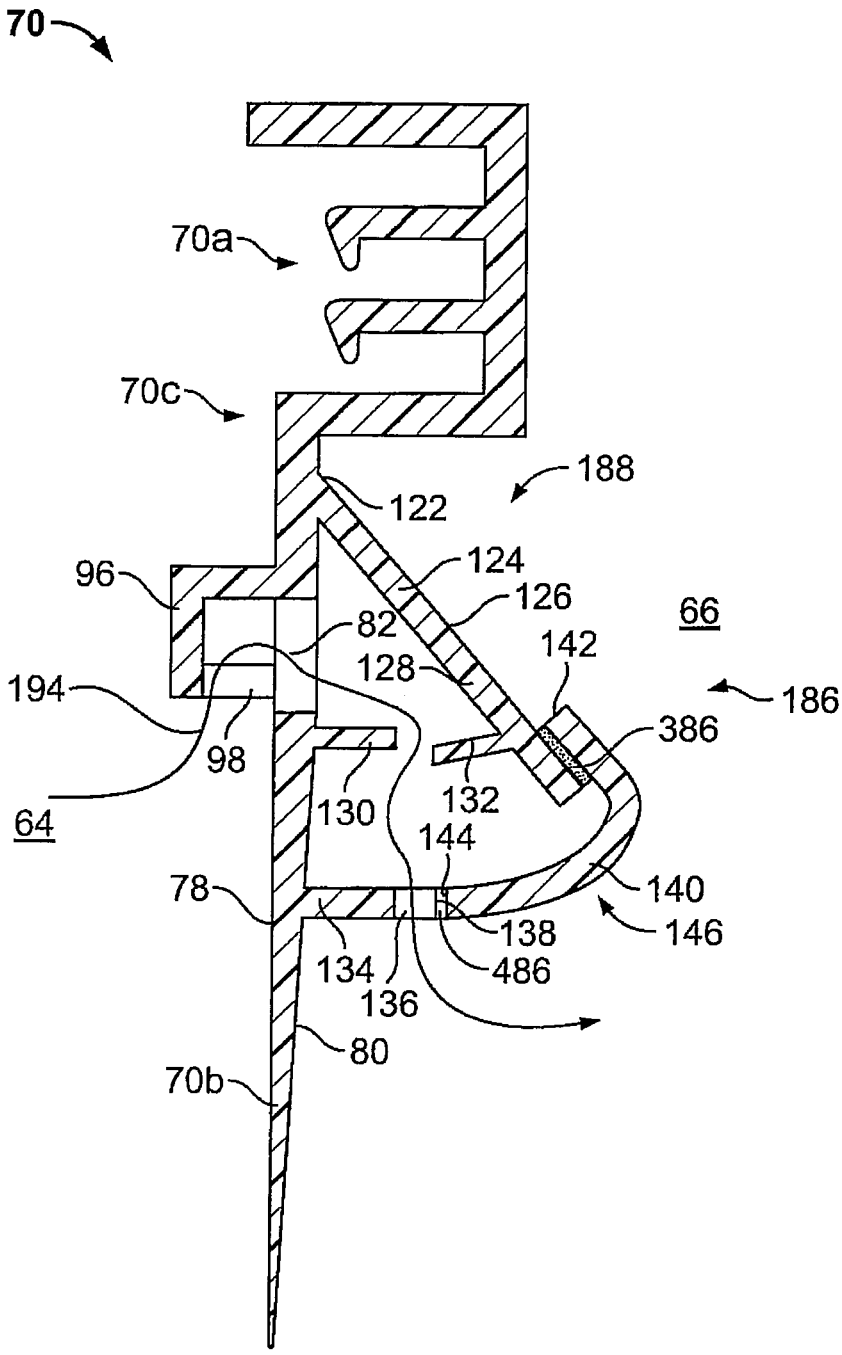
FIG. 10A is a cross-sectional view of yet another embodiment of a first closure element in an unsealed state taken generally along the lines 10-10 of FIG. 8.

Referring to FIGS. 7-10, in another embodiment, a first complementary interlocking closure element 170 is similar to the first closure element 70, but includes the following differences. A resilient valve flap 186 includes a sealing member 188 and an at least partially elastomeric latch 146. The sealing member 188 includes a flap wall 120 and a hinged gate 124. The flap wall 120 extends from the exterior side 80 of the first flange 70*b*, and the hinged gate 124 extends from a distal end of the flap wall. The hinged gate 124 has an exterior side 126 and an interior side 128. A hinge 122 may be disposed in the flap wall 120 or in the hinged gate 124 or at a point where the flap wall is connected to the hinged gate, as shown in FIGS. 9 and 10. The hinging action of the hinged gate 124 to the flap wall 120 may be facilitated by any method known in the art including, for example, by a weakened area in the flap wall or by thinning one or both of the flap wall and the hinged gate proximate to the hinge 122. A first sealing wall 130 extends from the exterior side 80 of the first flange 70*b* and a second sealing wall 132 extends from the interior side 128 of the hinged gate 124. In another embodiment, the sealing member 188 may comprise a hinged gate 124 that is attached to or extends from the first flange 70*b*, as shown in FIG. 10A. The hinge 122 may be disposed on the hinged gate 124 or at a point where the hinged gate is connected to the first flange 70*b*, as shown in FIG. 10A.

The at least partially elastomeric latch 146 includes a support wall 134 and an elastomeric strip 140. The at least partially elastomeric latch 146 keeps the hinged gate 124 in a closed position, as shown in FIGS. 7 and 9. The support wall 134 extends from the exterior side 80 of the first flange 70*b* and includes a notch 136 disposed though the support wall proximate a distal end 138 thereof. The elastomeric strip 140 is sealed along a first edge 142 to the exterior side 126 of the hinged gate 124 and along a second edge 144 to the distal end 138 of the support wall 134. The elastomeric strip 140 may be sealed to the hinged gate 124 and the support wall 134 by sealing layers 386 and 486, respectively, as shown in FIGS. 7-10A. The sealing layers 386 and 486 may utilize any sealing method known in the art including, for example, a heat seal, an adhesive, or a thermoplastic weld layer. In the closed position, the first sealing wall 130 engages and forms a releasable airtight seal with the second sealing wall 132. The hinged gate 124 is biased by the at least partially elastomeric latch 146 to form a releasable airtight seal between the first and second sealing walls 130, 132.

In this embodiment, the hinged gate 124 and the at least partially elastomeric latch 146 may function together as a one-way check valve. For example, the pouch 50 may have the closure mechanism 58 occluded with a positive pressure difference across the hinged gate 124 from the exterior 66 to the interior 64 of the pouch 50, wherein the positive pressure difference allows the hinged gate to remain in a biased sealed position, as shown in FIGS. 7 and 9. However, a positive pressure difference across the hinged gate 124 from the interior 64 to the exterior 66 may cause the hinged gate to outwardly pivot from the hinge 122 and to separate the first and second sealing walls 130, 132 if the positive pressure difference is greater than a threshold level required to overcome the sealing bias of the at least partially elastomeric latch 146, as shown in FIGS. 8 and 10.

FIGS. 8 and 10 illustrate the hinged gate 124 that has outwardly pivoted under a sufficient positive pressure difference to separate the first and second sealing walls 130, 132. The notch 136 provides a fluid path, as indicated by the curved arrow 194, for fluid to escape from the interior 64 to the exterior 66 of the pouch 50. Upon a decrease of the positive pressure difference to below the threshold level required to overcome the sealing bias of the at least partially elastomeric latch 146, the hinged wall 124 returns to a sealing position, as shown in FIGS. 7 and 9. Although not shown, it is contemplated that the at least partially elastomeric latch 146 may comprise only an elastomeric member that would be sealed along a first edge to the exterior side 126 of the hinged gate 124 and along a second edge to the exterior side 80 of the first flange 70*b*. Such an entirely elastomeric latch may also include an aperture therethrough that would function as a fluid path for fluid to escape like the notch 136 in the at least partially elastomeric latch 146.

An evacuation pump or device (not shown) may also be used to evacuate fluid from the pouch 50 through, for example, the valve 68*a*, 68*b* disposed in one of the side walls 52, 54, or in or through one of the edges 56*a*-56*c*, or through the closure mechanism 58. An evacuation device may be placed over one or more of the apertures 82 to evacuate the pouch 50. In the embodiment illustrated in FIGS. 2-6, the evacuation device may be placed over one or more of the plurality of apertures 82 to evacuate the pouch 50. In the embodiments illustrated in FIGS. 7-10A, the evacuation device covers the entire hinged gate 124 to evacuate the pouch 50. Illustrative evacuation pumps or devices useful in the present disclosure include those disclosed in, for example, U.S. patent application Ser. No. 11/818,703, filed on Jun. 15, 2007, now U.S. Patent Application Publication No. 2008/0308177, and U.S. patent application Ser. No. 12/008,164, filed on Jan. 9, 2008, now U.S. Patent Application Publication No. 2009/0175747.

The resealable pouch 50 described herein can be made by various techniques known to those skilled in the art including those described in, for example, Geiger, et al., U.S. Pat. No. 4,755,248. Other useful techniques to make a resealable pouch include those described in, for example, Zieke et al., U.S. Pat. No. 4,741,789. Additional techniques to make a resealable pouch include those described in, for example, Porchia et al., U.S. Pat. No. 5,012,561. Additional examples of making a resealable pouch as described herein include, for example, a cast post applied process, a cast integral process, and/or a blown process. It is further contemplated that the resilient valve flap embodiments disclosed herein may also be used with containers other than thermoplastic pouches or bags similar to the valves disposed on hardwalled containers and lids, as shown in U.S. patent application Ser. No. 11/818,591, filed on Jun. 15, 2007, now U.S. Pat. No. 7,874,731.

In one embodiment, the first and second sidewalls 52, 54 and/or the closure mechanism 58 are formed from thermoplastic resins by known extrusion methods. For example, the sidewalls 52, 54 may be independently extruded of thermoplastic material as a single continuous or multi-ply web, and the closure mechanism 58 may be extruded of the same or different thermoplastic material(s) separately as continuous lengths or strands. Illustrative thermoplastic materials include polypropylene (PP), polyethylene (PE), metallocene-polyethylene (mPE), low density polyethylene (LDPE), linear low density polyethylene (LLDPE), ultra low density polyethylene (ULDPE), biaxially-oriented polyethylene terephthalate (BPET), high density polyethylene (HDPE), polyethylene terephthalate (PET), among other polyolefin plastomers and combinations and blends thereof. Further, the inner surfaces 60, 62 of the respective sidewalls 52, 54 or a portion or area thereof, or portions or areas of the first flange 70*b*, the resilient valve flap 86, or the first and second sealing walls 130, 132 may, for example, be composed of an elastomer or polyolefin plastomer such as an AFFINITY™ resin manufactured by Dow Plastics. Such portions or areas include, for example, the area of one or both of the sidewalls 52, 54 proximate and parallel to the closure mechanism 58 to provide an additional cohesive seal between the sidewalls 52, 54 when the pouch 50 is evacuated, or the portions or areas of the first and second sealing walls 130, 132 that engage one another to form an airtight seal therebetween, or the portions or areas of the resilient valve flap 86 and the raised lip 84 or the first flange 70*b* that form an airtight seal therebetween. One or more of the sidewalls 52, 54 in other embodiments may also be formed of an air-impermeable film. An example of an air-impermeable film includes a film having one or more barrier layers, such as an ethylene-vinyl alcohol copolymer (EVOH) ply or a nylon ply, disposed between or on one or more of the plies of the sidewalls 52, 54. The barrier layer may be, for example, adhesively secured between the PP and/or LDPE plies to provide a multilayer film. Other additives such as colorants, slip agents, and antioxidants, including, for example, talc, oleamide or hydroxyl hydrocinnamate may also be added as desired. In another embodiment, the closure mechanism 58 may be extruded primarily of molten PE with various amounts of slip component, colorant, and/or talc additives in a separate process. The fully formed closure mechanism 58 may be attached to the pouch body using a strip of molten thermoplastic weld material, or by an adhesive known by those skilled in the art, for example. Other thermoplastic resins and air-impermeable films useful in the present disclosure include those disclosed in, for example, Tilman et al. U.S. Patent Application Publication No. 2006/0048483.

INDUSTRIAL APPLICABILITY

A closure mechanism for a pouch is presented that includes a first interlocking closure element and a second interlocking closure element. A closure profile is disposed on an interior side of the first interlocking closure element. A flange extends from the closure profile and an aperture is disposed therethrough. A resilient valve flap is disposed over the aperture and attached to an exterior side of the flange. A channel is defined by an area of non-attachment of the resilient valve flap to the flange that extends from the aperture to an edge of the resilient valve flap. The resilient valve flap is biased to form a releasable airtight seal in the area of non-attachment of the resilient valve flap to the flange. The closure mechanism may be used with an evacuation device to expel excess air out of the pouch and to form a vacuum therein to keep food or other perishable contents stored inside the pouch fresh for an extended period of time.

Numerous modifications to the present disclosure will be apparent to those skilled in the art in view of the foregoing description. Accordingly, this description is to be construed as illustrative only and is presented for the purpose of enabling those skilled in the art to make and use the invention and to teach the best mode of carrying out the same. The exclusive rights to all modifications that come within the scope of the appended claims are reserved. All patents, patent publications and applications, and other references cited herein are incorporated by reference herein in their entirety.

I claim:

1. A closure mechanism for a pouch, the closure mechanism comprising:
- a first interlocking closure element and a second interlocking closure element;
- a first closure profile disposed on an interior side of the first interlocking closure element;
- a flange extending from the first closure profile and having a first aperture disposed therethrough;
- a resilient valve flap covering the first aperture and attached to an exterior side of the flange, wherein the resilient valve flap comprises a sealing member and an at least partially elastomeric latch attached between a distal end of the sealing member and the exterior side of the flange, wherein the sealing member comprises a first sealing wall that extends from the exterior side of the flange and a second sealing wall that extends from an interior side of a hinged gate, the first and second sealing walls engaging to form an airtight seal therebetween, and wherein the at least partially elastomeric latch comprises a support wall extending from the exterior side of the flange and an elastomeric strip attached between a distal end of the support wall and a distal end of the hinged gate; and
- a channel defined between the resilient valve flap and the flange that extends from the first aperture to an edge of the resilient valve flap,
- wherein the resilient valve flap is biased to form a releasable airtight seal against the exterior side of the flange across the channel.

2. The closure mechanism of claim 1, wherein the exterior side of the flange comprises a protruding lip surrounding the first aperture that presses against the resilient valve flap.

3. The closure mechanism of claim 2, wherein the resilient valve flap is attached to the flange by a heat seal.

4. The closure mechanism of claim 1, wherein a second aperture is disposed through the at least partially elastomeric latch.

5. The closure mechanism of claim 1, wherein the flange comprises a second closure profile disposed on an interior side thereof opposite to the first aperture, wherein the second closure profile includes a second aperture in fluid communication with the first aperture.

6. The closure mechanism of claim 1, wherein the first interlocking closure element is attached to a surface of a first sidewall of a pouch and the second interlocking closure element is attached to a surface of a second sidewall of the pouch, the first and second sidewalls being sealed to one another to define an interior of the pouch and a primary opening, and wherein at least one of the first and second sidewalls is embossed or textured to provide flow channels in a region of the interior of the pouch.

7. The closure mechanism of claim 6, wherein the first and second interlocking closure elements are disposed along the primary opening of the pouch, and one or more of the closure elements includes a closure profile having a textured portion along the length of each profile to provide at least one of tactile and audible sensations when the closure mechanism is occluded.

8. The closure mechanism of claim 1, wherein a portion of at least one of the resilient valve flap and a portion of the flange that forms an airtight seal therebetween is comprised of at least one of an elastomer and a layer of an AFFINITY™ resin.

9. A closure element for a closure mechanism, the closure element comprising:
- a closure profile;
- a flange extending from the closure profile and having an aperture disposed therethrough, wherein the flange has first and second opposite sides and the closure profile is arranged on a first side of the flange;
- a resilient valve flap covering the aperture and attached to the second side of the flange, wherein the resilient valve flap comprises a sealing member and an at least partially elastomeric latch attached between a distal end of the sealing member and the exterior side of the flange, wherein the sealing member comprises a first sealing wall that extends from the exterior side of the flange and a second sealing wall that extends from an interior side of a hinged gate, the first and second sealing walls engaging to form an airtight seal therebetween, wherein the at least partially elastomeric latch comprises a support wall extending from the exterior side of the flange and an elastomeric strip attached between a distal end of the support wall and a distal end of the hinged gate; and a channel defined between the resilient valve flap and the flange that extends from the aperture to an edge of the resilient valve flap, wherein the resilient valve flap is biased to form a releasable airtight seal against the second side of the flange across the channel.

10. The closure element of claim 9, wherein the second side of the flange comprises a protruding lip surrounding the aperture that presses against the resilient valve flap.

11. The closure element of claim 9, wherein the resilient flap is attached to the flange by a thermoplastic weld layer.

12. A resealable valve comprising:

a flange extending from a closure element and including an aperture disposed therethrough in fluid communication with an interior side of the closure element, the aperture extending through the flange from the interior side to an exterior side of the flange;

a resilient valve flap covering the aperture on the exterior side of the flange and attached to the exterior side of the flange, wherein the resilient valve flap comprises a sealing member and an at least partially elastomeric latch attached between a distal end of the sealing member and the exterior side of the flange, wherein the sealing member comprises a first sealing wall that extends from the exterior side of the flange and a second sealing wall that extends from an interior side of a hinged gate, the first and second sealing walls engaging to form an airtight seal therebetween, and wherein the at least partially elastomeric latch comprises a support wall extending from the exterior side of the flange and an elastomeric strip attached between a distal end of the support wall and a distal end of the hinged gate; and a channel defined between the resilient valve flap and the flange that extends from the aperture to an edge of the resilient valve flap, wherein the resilient valve flap is biased to form a releasable airtight seal against the exterior side of the flange across the channel.

13. The resealable valve of claim 12, wherein the flange and the closure element are integral components and the flange is attached to a first sidewall of a pouch that has a complementary closure element disposed on a second opposing sidewall.

14. The resealable valve of claim 13, wherein the resealable valve runs along an entire top ridge of the pouch.

15. The resealable valve of claim 13, wherein at least one of the first and second sidewalls is embossed or textured to form flow channels in an interior portion of the pouch.

16. The resealable valve of claim 12, wherein the flange has multiple apertures disposed therethrough covered by the resilient valve flap and corresponding channels defined between the resilient valve flap and the flange, wherein each of the channels extends from the respective aperture to an edge of the resilient valve flap.

* * * * *